US008506197B2

(12) United States Patent
Beaty et al.

(10) Patent No.: US 8,506,197 B2
(45) Date of Patent: Aug. 13, 2013

(54) CLEANING OR APPLICATING APPARATUS AND DISPENSING SYSTEM

(76) Inventors: Thomas Howard Beaty, Statesville, NC (US); Payton Autrey Morrison, Sr., Statesville, NC (US)

( * ) Notice: Subject to any disclaimer, the term of this patent is extended or adjusted under 35 U.S.C. 154(b) by 523 days.

(21) Appl. No.: 12/828,603

(22) Filed: Jul. 1, 2010

(65) Prior Publication Data

US 2012/0003028 A1 Jan. 5, 2012

(51) Int. Cl.

| | |
|---|---|
| ***A46B 9/02*** | (2006.01) |
| ***A46B 7/00*** | (2006.01) |
| ***A46B 7/02*** | (2006.01) |
| ***A46B 7/06*** | (2006.01) |
| ***A47L 25/00*** | (2006.01) |
| ***A47L 13/10*** | (2006.01) |

(52) U.S. Cl.
USPC ..... 401/270; 401/99; 15/160; 15/201; 15/210.1; 15/244.1; 222/205

(58) Field of Classification Search
USPC ..... 15/201; 401/118, 126, 129
See application file for complete search history.

(56) References Cited

U.S. PATENT DOCUMENTS

| | | | | |
|---|---|---|---|---|
| 2,754,821 | A | 7/1956 | Burbig et al. | |
| 2,882,544 | A * | 4/1959 | Hadidian | 15/167.1 |
| 2,935,755 | A * | 5/1960 | Alberto et al. | 15/167.1 |
| 3,203,025 | A * | 8/1965 | Schreur | 401/284 |
| 3,841,532 | A * | 10/1974 | Gores | 222/205 |
| 3,862,806 | A * | 1/1975 | Brown | 401/118 |
| 3,866,437 | A * | 2/1975 | Spencer | 62/408 |
| 4,226,340 | A * | 10/1980 | Troesch | 222/183 |
| 4,420,099 | A * | 12/1983 | Pizzurro et al. | 222/205 |
| 4,694,844 | A * | 9/1987 | Berl et al. | 15/167.1 |
| 4,757,922 | A | 7/1988 | Landecker | |
| 5,546,626 | A * | 8/1996 | Chung | 15/167.1 |
| 6,018,839 | A * | 2/2000 | Pietz | 15/167.1 |
| 6,883,991 | B2 * | 4/2005 | Gueret | 401/130 |
| 7,284,293 | B1 | 10/2007 | Holder et al. | |
| 7,454,813 | B2 | 11/2008 | Kaltenegger | |

* cited by examiner

*Primary Examiner* — David Walczak
*Assistant Examiner* — Joshua Wiljanen
(74) *Attorney, Agent, or Firm* — Oliff & Berridge, PLC

(57) ABSTRACT

A first apparatus includes a base, a plurality of stems, each stem having a first end retained by the base and a second end opposite the first end. Each stem is movable between a withdrawn position and an extended position with respect to the base, such that the second end projects from the base when the stem is in the extended position. Flexible tips are attached respectively to the second ends of the stems. A second apparatus includes a storage vessel, a cup dimensioned to receive the flexible tips of the first apparatus, and a dispensing mechanism linking the storage vessel to the cup.

18 Claims, 11 Drawing Sheets

CLEANING OR APPLICATING APPARATUS AND DISPENSING SYSTEM

TECHNICAL FIELD OF THE INVENTION

This invention relates generally to a cleaning or applicating apparatus, and more particularly to an apparatus having flexible tips mounted on movable stems for cleaning or delivering any desired material to uneven variable geometric surfaces.

BACKGROUND OF THE INVENTION

Keyboards are found as computer-related hardware in almost every typical office, place of work, school, library, hospital, and home. Typical users at best take little or no particular care in preventing their keyboards from getting dirty, and at worst consume snacks and groom at their workstations. Thus, food crumbs, human dander, bacteria, environmental dust particles and other debris fall onto the keys and into the spaces between the keys. Where multiple users share a single keyboard, unsanitary conditions arise as multiple people are exposed to debris left by others. Even when the use of a keyboard or keypad such as that of a mobile phone or other electronic device is limited to one user, that user can inadvertently be re-exposed to previous contaminants even after washing their hands if the keyboard or keypad is not cleansed as well.

Generic-use brushes for general cleaning are available, but a typical brush has bristles fixed together in a handle such that the bristles can only move relative to each other by their own deformation. Thus, when a typical wide-area flat cleaning brush is used to scrub a keyboard, keys are likely to be pressed prompting unintended actions by any computer connected to the key board. Even if such computer actions during cleaning are not a concern, the bristles that bear upon the top surfaces of the keys typically prevent other bristles positioned between the keys from reaching into the full depth of the spaces in the keyboard.

Compressed gas canisters are available for blowing dust from keyboards and other surfaces, but such practices at best merely redistribute contaminants and at worst cause dust and debris to become air borne and possibly inhaled. Such canisters also are noisy upon use, and thus would create distractions in work places, schools, and libraries if widely used, and could disturb resting patients in hospitals.

Employers such as hospitals are becoming increasingly aware of the threats that unsanitary keyboards represent to weakened patients through the possibility that bacteria and other infectious biological elements can be transferred from caregivers' hands to patients. Even non-medical employers, out of concern both for the health of their employees and toward the costs of health care and time lost at work, are increasingly considering hygiene-improving measures such as hand sanitizers. Beyond the workplace, parents are increasingly aware that influenza and other bugs are brought into their homes by their children from schoolmates, and that infections can then easily spread to family members of all ages, for example through the shared use of contaminated keyboards. Dry brushing alone is not generally believed to be sufficient to sanitize a surface tainted with infectious contaminants.

Wherever uneven variable geometric surfaces are found, their cleaning and the application of product materials upon them are a challenge for which improved cleaning and applicating devices are needed. For example, items moving along a conveyor belt in an assembly line may require cleaning or the application of a solution or coating.

BRIEF SUMMARY OF THE INVENTION

According to at least one embodiment of the invention, an apparatus includes a base, and a plurality of rigid stems. Each stem has a first end retained by the base, and a second end opposite the first end. Each stem is movable between a withdrawn position and an extended position with respect to the base, such that the second end projects from the base when the stem is in the extended position. Flexible tips are attached respectively to the second ends of the stems.

In at least one example, the base includes a face plate through which multiple first guide holes are formed. The base includes a guiding plate positioned parallel to the face plate. The guiding plate has multiple second guide holes aligned respectively with the first guide holes, and the stems slide within, and are maintained parallel to each other by, the aligned first and second guide holes.

The base may further include a backing plate positioned parallel to the guiding plate, with the first ends of the stems being retained between the guiding plate and the backing plate, such that the spacing between the guiding plate and the backing plate defines a distance between the withdrawn position and extended position of each stem. In at least one example, the first end of each stem has a respective head dimensioned larger than the second guide holes such that the head is trapped between the guide plate and backing plate.

In at least one example, a biasing element biases at least one stem toward its extended position.

In at least one example, a biasing element within the base is in contact with the first ends of the stems and biases each stem toward its extended position.

Each flexible tip may include, for example, a brush, a sponge, a woven material, or a non-woven material.

In at least one example, the base has polygonal guide holes through which the stems extend from the base in the extended positions. For example, the polygonal guide holes may be hexagonal.

Each stem may have longitudinally extending ridges. In at least one example, the base has polygonal guide holes through which the stems extend from the base in the extended positions, and each polygonal guide hole has multiple linear sides. In that example, each stem has longitudinally extending ridges, and each stem has more ridges than each guide hole has linear sides.

In at least one example, each stem has exactly eight ridges, and each guide hole has exactly six linear sides.

In at least one example, the base has an internal chamber and an inlet port for receiving pressurized gas or fluid into the internal chamber such that the stems are biased toward their extended positions by the pressurized gas or fluid.

According to another embodiment of the invention, a kit includes a first apparatus and a second apparatus. The first apparatus includes a base, a plurality of stems, each stem having a first end retained by the base and a second end opposite the first end. Each stem is movable between a withdrawn position and an extended position with respect to the base, such that the second end projects from the base when the stem is in the extended position. Flexible tips are attached respectively to the second ends of the stems. The second apparatus includes a storage vessel, a cup dimensioned to receive the flexible tips of the first apparatus, and a dispensing mechanism linking the storage vessel to the cup.

In at least one example, the base includes a cap that removably engages and seals with a top edge of the cup.

In at least one example, the storage vessel contains a liquid.

In at least one example, the storage vessel includes a pressurized canister.

In at least one example, the dispensing mechanism includes a pump connected to the storage vessel and to the cup such that pressing the cup toward the storage vessel actuates the pump.

In at least one example, the base has polygonal guide holes through which the stems extend from the base in the extended positions.

In at least one example, each stem has longitudinally extending ridges.

BRIEF DESCRIPTION OF THE DRAWINGS

The subject matter that is regarded as the invention may be best understood by reference to the following description taken in conjunction with the accompanying drawing Figures in which.

DETAILED DESCRIPTION OF THE INVENTION

Figure 3:
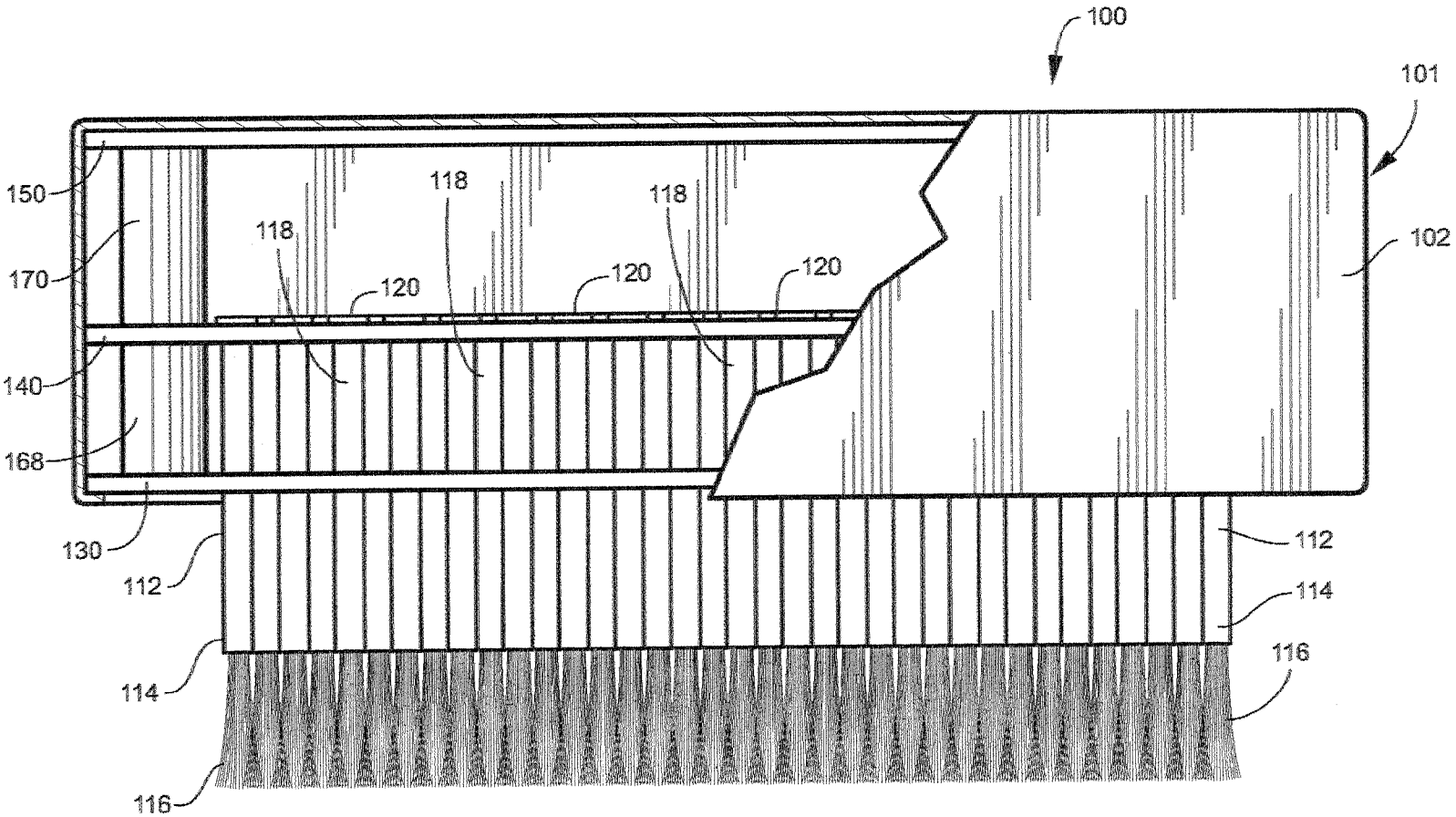
FIG. 3 is a partially broken elevation view of the apparatus of FIG. 1.
Figure 4:
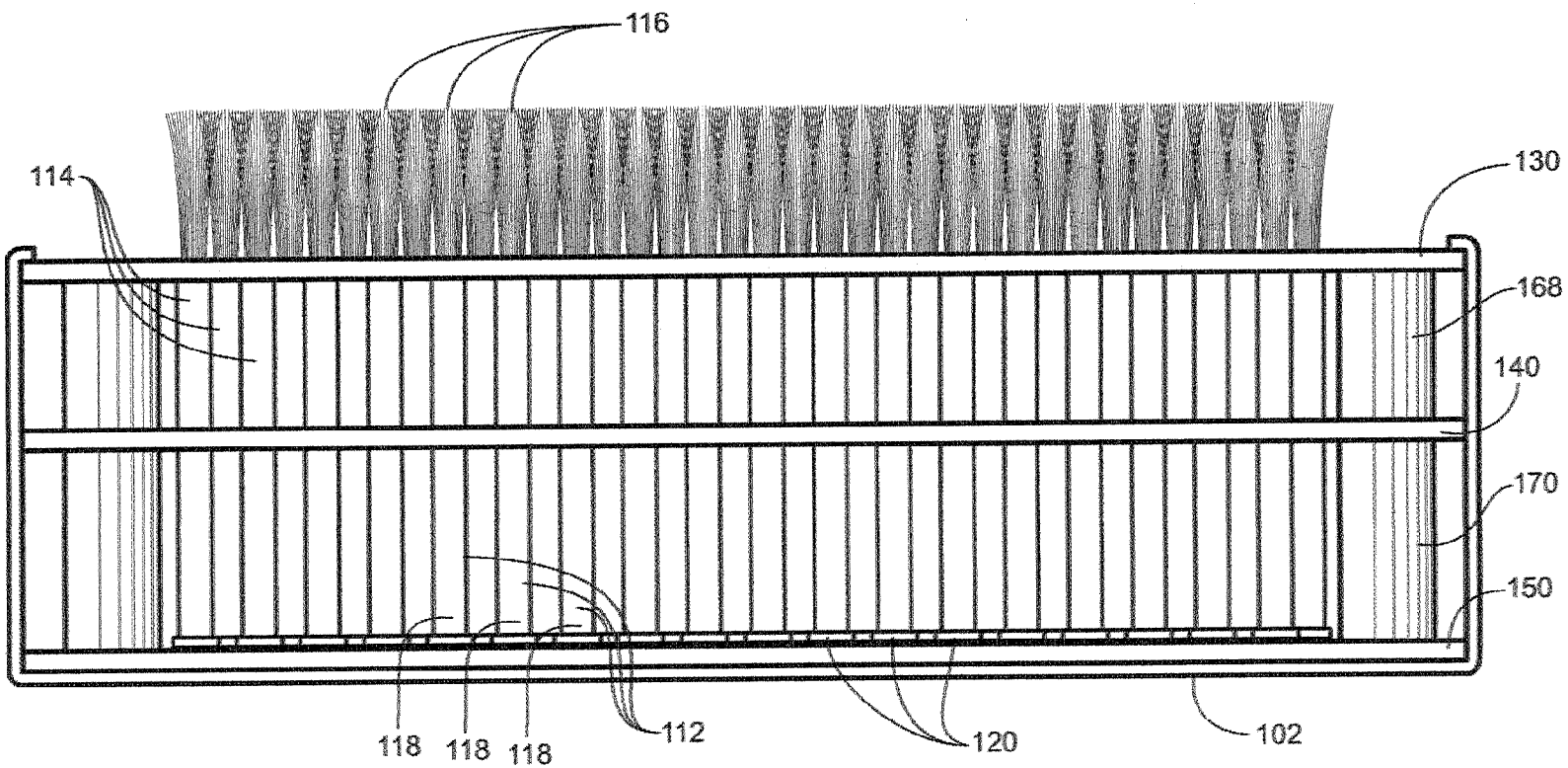
FIG. 4 is an internal elevation view of the apparatus of FIG. 1.
Figure 5:
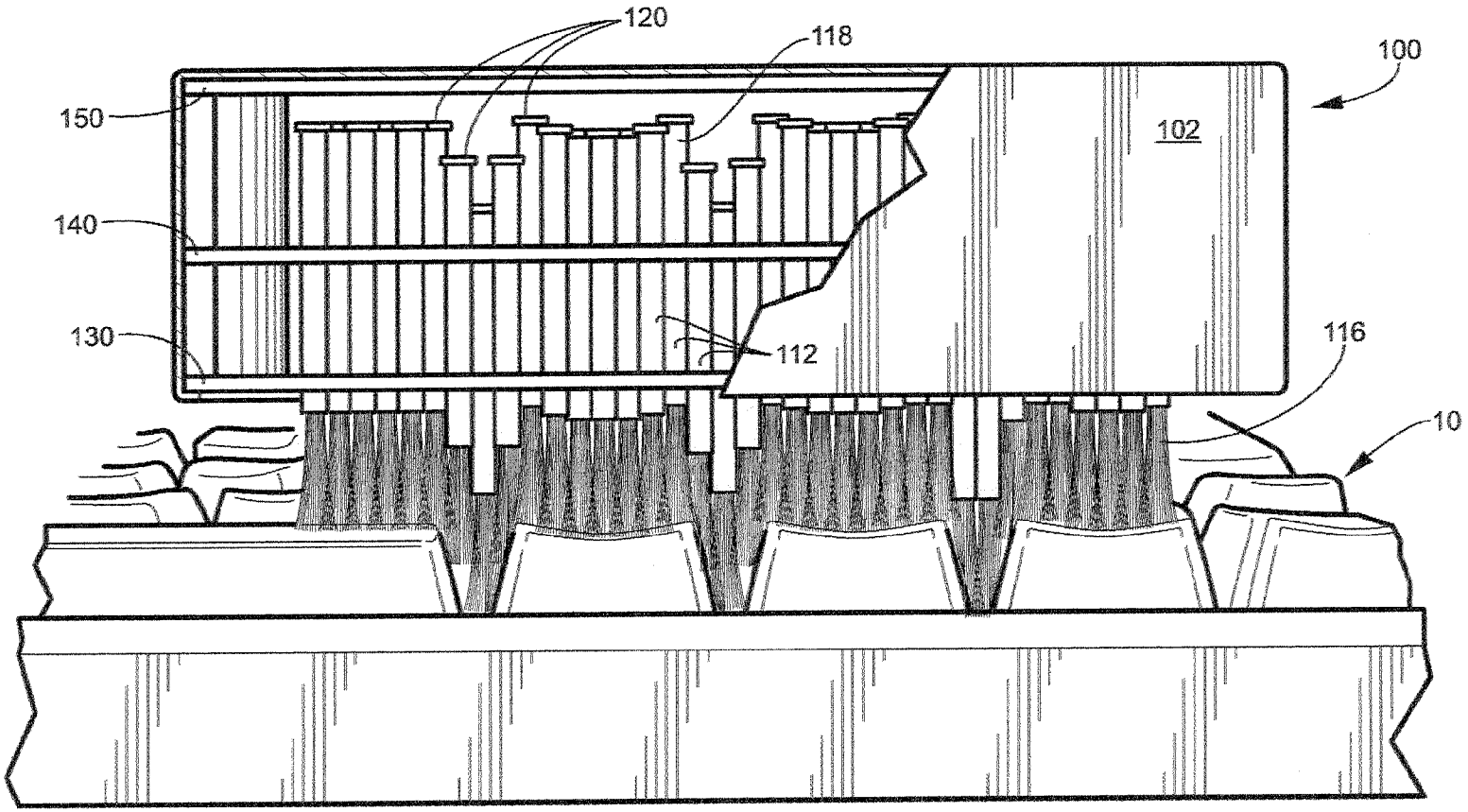
FIG. 5 is a partially broken perspective environmental view of the apparatus of FIG. 1 in use in cleaning a keyboard.

Referring to the drawings wherein identical reference numerals denote the same elements throughout the various views, FIGS. 1-5 illustrate a cleaning or applicating apparatus 100, according to one embodiment of the present invention. As shown, the apparatus 100 includes a plurality of stems 112 that extend and withdraw relative to a base 102, as shown respectively in FIGS. 3 and 4, for use in cleaning an uneven variably geometric surface, or for use in applying a desired material to the surface. The surface shown under treatment in FIG. 5 is that of a keyboard 10, which is provided as an example without limiting these descriptions. It should be understood that other surfaces and objects may be treated by use of the cleaning or applicating apparatus 100.

Figure 7:
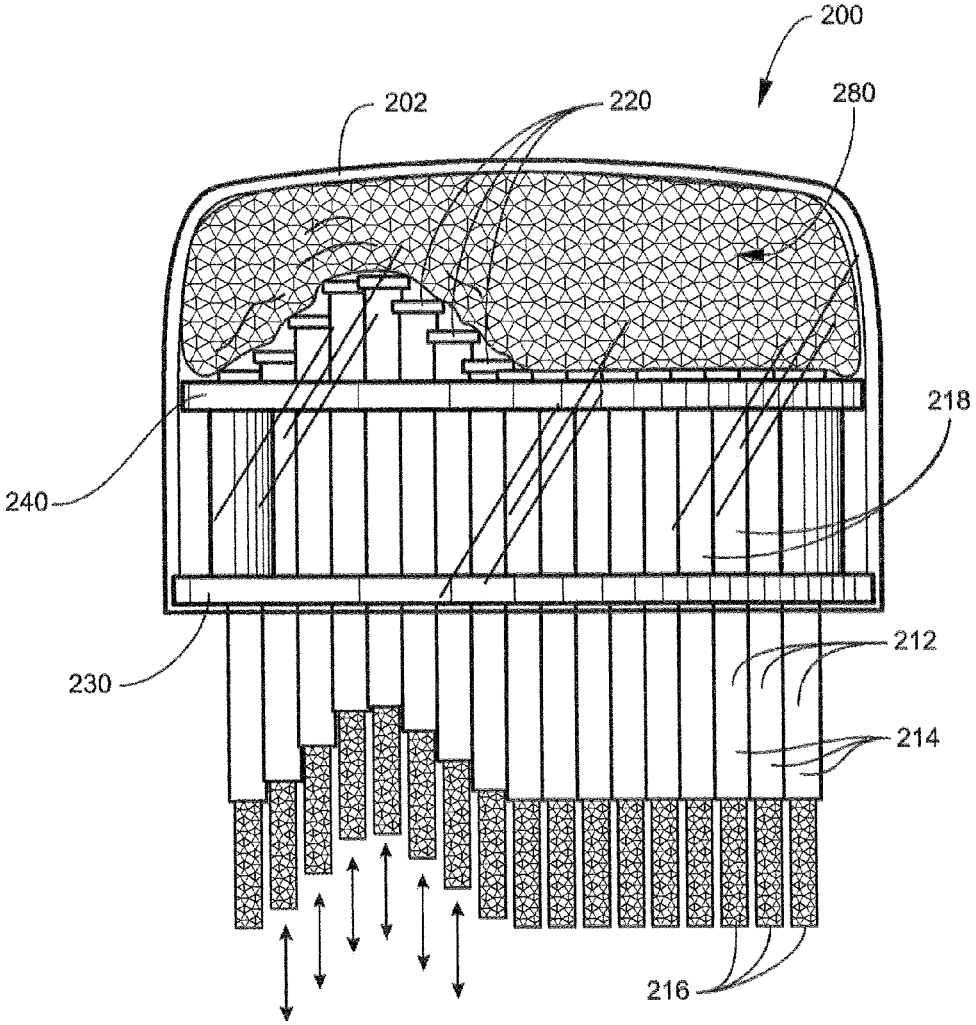
FIG. 7 is an elevation view of another apparatus according to another embodiment of the invention, having a biasing element that biases stems toward their extended positions.

Each stem 112 is at least semi-rigid and has a trapped first end 118 (FIGS. 3-5) and a free second end 114, from which a flexible tip 116 extends. The trapped end 118 has a head 120 that is enlarged relative to the stem 112. The flexible tips 116 in FIGS. 1-5 are illustrated as brushes consisting of multiple flexible fibers. Other types of flexible tips, such as woven and non-woven materials, are nonetheless within the scope of these descriptions. For example, FIG. 7 illustrates flexible tips consisting of natural or synthetic sponges or other flexible fluid-absorbing and dispensing materials.

Figure 1:
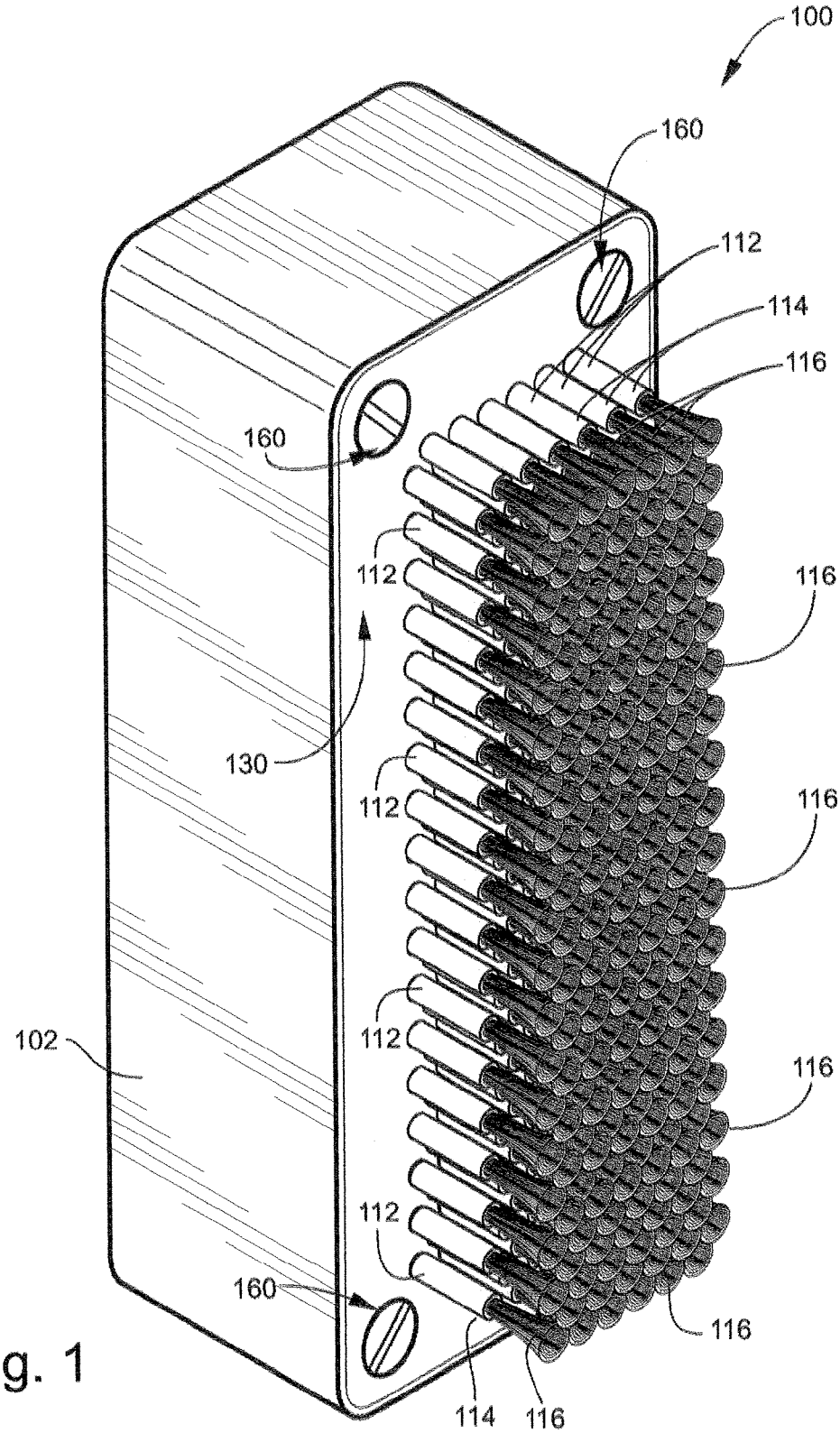
FIG. 1 is a perspective view of a cleaning or applicating apparatus according to one embodiment of the present invention.
Figure 2:
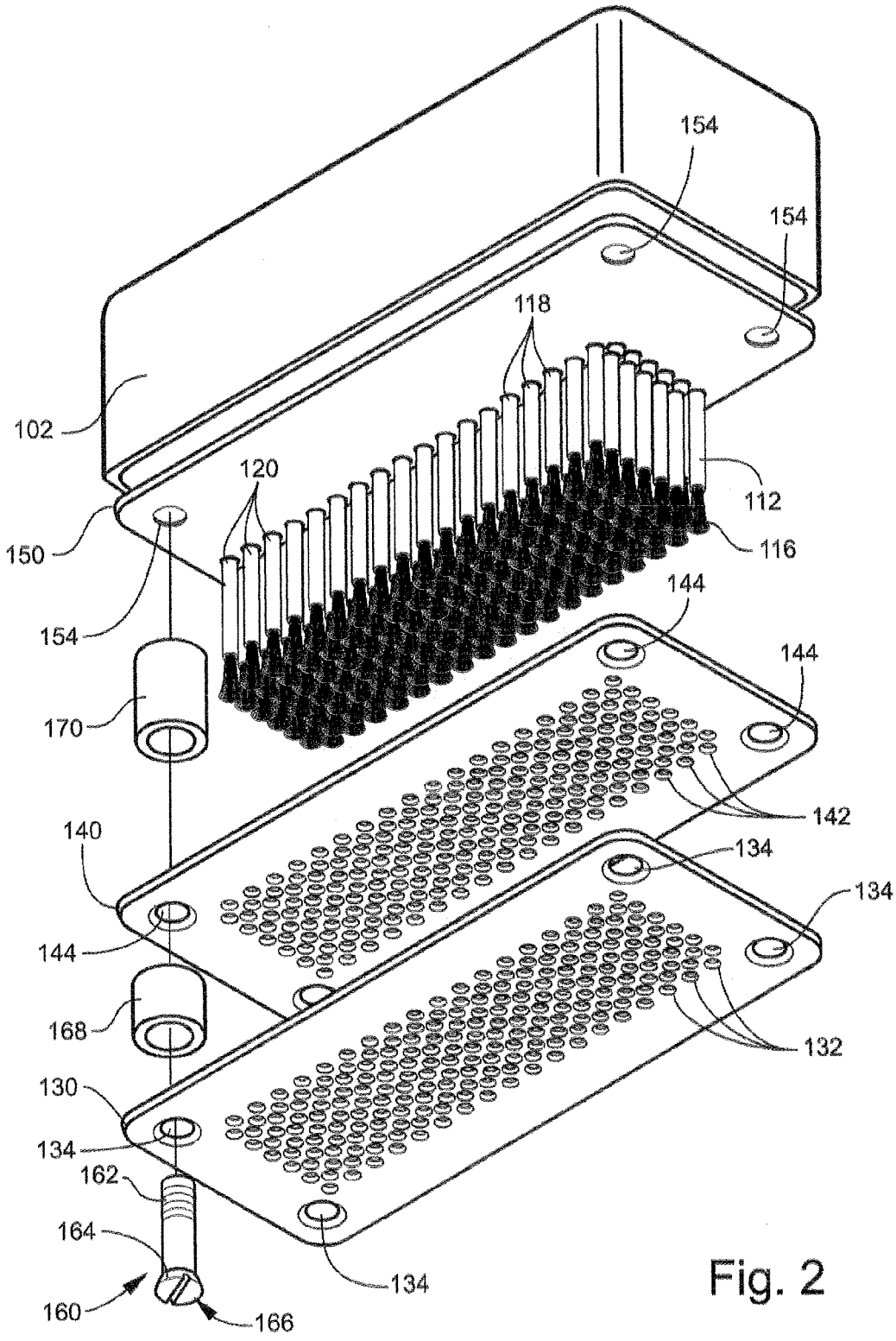
FIG. 2 is an exploded perspective view of the apparatus of FIG. 1.

As shown in FIG. 2, the base 102 has a face plate 130, and a guiding plate 140 positioned parallel to the face plate 130. The face plate 130 and guiding plate 140 have respective matrices of guide holes 132 and 142. The two matrices are essentially identically patterned so that each individual hole 132 of the face plate 130 aligns with an individual hole 142 of the guiding plate 140 when the apparatus 100 is assembled. The stems 112 are maintained in parallel relation by the aligned guide holes 132 and 142 of the face plate 130 and guide plate 140 throughout the movements of the stems 112.

A parallel backing plate 150 is positioned on the opposite side of the guiding plate 140 relative to the face plate 130. Each plate 130, 140 and 150 has several respective connector holes 134, 144 and 154 that facilitate the assembly of the apparatus 100. In the example illustrated in FIGS. 1-5, a respective threaded screw 160 is passed through each linear arrangement of the holes 134, 144 and 154 and its threaded end 162 is received and retained by a threaded hole within the base 102 of the apparatus 100 or by another retainer such as a threaded nut abutting the back surface of the backing plate 150. Each screw 160 has a cone-shaped countersink head 164 having a flat face 166 that is positioned flush with the face plate 130 when the apparatus 100 is assembled. First spacers 168 are trapped by the screws 160 between the face plate 130 and the guiding plate 140, and maintain the face plate and guiding plate in parallel relation. Second spacers 170 are similarly trapped between the guiding plate 140 and the backing plate 150, and maintain the guiding plate and backing plate in parallel relation.

The guide holes 132 and 142 of the face plate 130 and guide plate 140 are dimensioned and shaped to permit the stems 112 to slide freely between fully extended positions as shown in FIG. 3 and fully withdrawn positions as shown in FIG. 4. The heads 120 at the trapped ends 118 of the stems 112 are dimensioned larger than the guide holes 142 of the guide plate 140. Thus, the guide plate 140 prevents the stems 112 from escaping the cleaning or applicating apparatus 100.

The fully extended position of each stem 112 is reached when its head 120 reaches the guide plate 140. The backing plate 150 is contacted by the heads 120 as the stems reach their fully withdrawn positions. The distance between the fully withdrawn position and the fully extended position of each stem 112 is set by the lengths of the second spacers 170 as they define the depth of the space between the backing plate 150 and guide plate 140 in which the heads 120 are trapped. In at least one example, a back interior wall of the base 102 serves as the backing plate by abutting the heads 120 of the stems 112 in their fully withdrawn positions.

The components of the cleaning or applicating apparatus 100 can be constructed from a variety of materials. The stems 112 can consist of rigid plastic tubes for example, having their trapped ends 118 deformed by heat, crimping or stress to form their heads 120 (FIGS. 3 and 5). Alternatively, the heads 120 can be caps or small plates attached to the trapped ends 118. The flexible tips 116 can be natural or synthetic fiber brushes or sponges or foam, flexible rubbery tips, or other flexible materials such as woven and non-woven materials. They may have flat ends as shown in FIG. 3 or they may have tapered or rounded ends. The plates 130, 140 and 150 and the base 102 may be formed from rigid materials such as plastics or metals. The plates and housing may be transparent, translucent, or opaque having any desired color. The cleaning or applicating apparatus 100 of FIGS. 1-5 is maintained in an assembled state by threaded screws 160. Other examples of a cleaning or applicating apparatus otherwise within the scope of these descriptions are held together by rivets, epoxies, bonding techniques, friction fits, and other fixing means.

The stems 112 slide freely between fully extended positions as shown in FIG. 3 and fully withdrawn positions as shown in FIG. 4. Each stem 112 travels independently of the others. During use of the cleaning or applicating apparatus 100, the plates 130, 140 and 150 and the base 102 together define a handle from which the stems 112 project in their extended positions and into which the stems at least partially recede in their withdrawn positions, with the flexible tips 116 projecting outward from the base in both the extended and withdrawn positions of the cleaning implements. When the apparatus 100 is passed over a uneven variable surface such as a keyboard 10 as shown in FIG. 5, each stem 112 extends under gravity so that both high and low points of the surface are reached by the flexible tips 116. The total weight of several stems 112 and their flexible tips 116 is less than the typical force required to press a key of a typical computer keyboard. Thus, inadvertent actions of a computer or other keyboard or keypad controlled device are not prompted by the pressing of keys as the keyboard is cleaned. This is true even when several dozen stems 112 and their flexible tips 116 at once bear upon a larger key such as an "Enter" key.

In proper use of the cleaning or applicating apparatus 100, the base 102 is held and passed above a surface to be cleaned as shown in FIG. 5. Care should be taken to assure both that the flexible tips 116 can reach all features desired to be treated, and that the user does not bear down upon the base 102. The stems 112 can only retract as far as their withdrawn positions, and once they reach their withdrawn positions, any further forces applied by the user will be transferred to the surface under treatment. Thus, improper use can lead to the pressing of keys on a keyboard or even the damage of delicate components under treatment. When properly used, with the stems 112 freely reciprocating under gravity between their withdrawn and extended positions as the apparatus 100 passes over a surface under treatment, the flexible tips apply gentle and even pressure across the surface even as uneven surface features of various heights are encountered.

Figure 6:
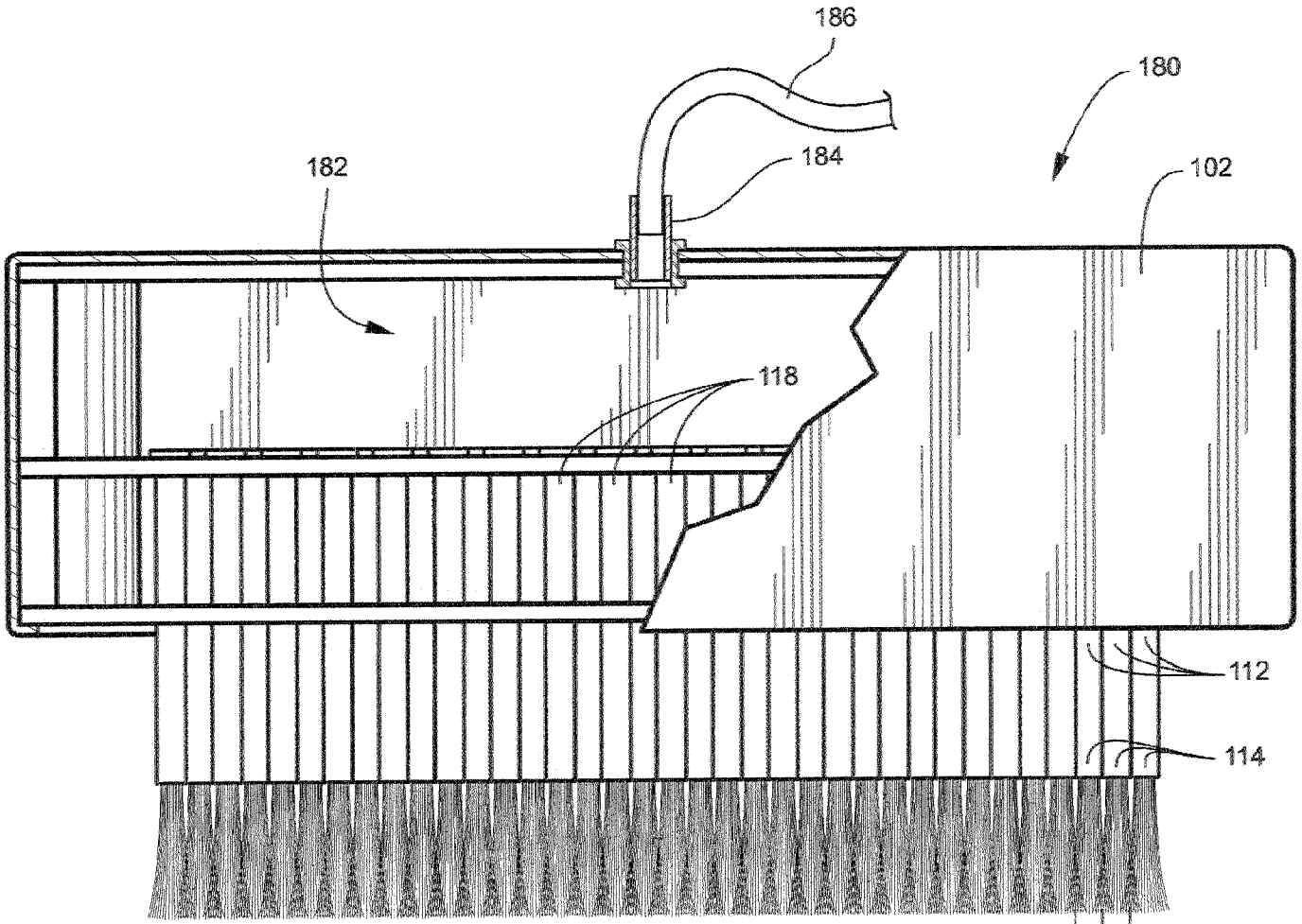
FIG. 6 a partially broken perspective environmental view of another cleaning or applicating apparatus according to another embodiment of the present invention, in which pressurized gas or fluid biases stems toward their extended positions.

Another cleaning or applicating apparatus 180, according to another embodiment of the invention, is shown in FIG. 6. The apparatus 180 bears many similarities to the apparatus 100. Therefore, many of the above descriptions of FIGS. 1-5 apply as well to FIG. 6. The apparatus 180 includes a plurality of stems 112 that extend and withdraw relative to a base 102. Each stem 112 is at least semi-rigid and has a trapped first end 118 and a free second end 114, from which a flexible tip 116 extends. In the example of FIG. 6, the base 102 has an internal chamber 182 and an inlet port 184 for receiving pressurized gas or fluid, from a line 186, into the internal chamber such that the stems 112 are biased toward their extended positions by the pressurized gas or fluid. The apparatus 180 is therefore useful in any orientation and may be used with the stems extending upward because the stems 112 extend according to pressure within the chamber 182, whereas the stems 112 of FIGS. 1-5 rely upon gravity to pull them toward their extended positions. The pressure within the internal chamber 182 can be set to any desired pressure level to set the force required to move each stem from its extended position.

Another cleaning or applicating apparatus 200, according to another embodiment of the invention, is shown in FIG. 7. The apparatus 200 includes a plurality of stems 212 that extend and withdraw relative to a base 202 as shown by way of both extended and withdrawn stems being shown. Each stem 212 has a first end 218 retained by the base 202 and a second end 214 from which a flexible tip 216 extends. Each second end 218 has a head 220 that is trapped within the housing 202. The flexible tips 216 in FIG. 7 are illustrated as natural or synthetic sponges or other flexible fluid-absorbing materials. Other types of flexible tips, such as those shown in FIGS. 1-5, are within the scope of these descriptions as well.

As shown in FIG. 7, a guiding plate 240 is positioned parallel to a face plate 230. The face plate 230 and guiding plate 240 have respective matrices of aligned guide holes dimensioned and shaped to permit sliding movement of the stems 212, while trapping the heads 220 from passing beyond the guiding plate 240. Thus, the cleaning apparatus 200 in FIG. 7 bears similarities to the cleaning apparatus 100 of FIGS. 1-5, such that some of these descriptions apply to both examples and such that their features may be combined.

FIG. 7 does additionally illustrate a biasing element 280 that applies forces to the stems 212 toward their extended positions. The biasing element 280 is trapped between the guiding plate 240 and the cupped housing 202. Thus, whereas the stems 112 of FIGS. 1-5 rely upon gravity to pull them toward their extended positions, the stems 212 are held in their extended positions until an external force overcomes that of the biasing element 280 and causes affected stems 212 to deform the biasing element 280 in the areas where their heads 220 contact the biasing element as shown. The biasing element 280 shown is a single piece of resilient material such as sponge or foam. A single biasing element 280 can press all of the stems 212 toward their extended positions or multiple biasing elements can be used. In one example of a cleaning apparatus according to the invention, stems and biasing elements are in one-to-one correspondence such that each stem is singly urged forward by a dedicated respective biasing element, which can be a piece of resilient material like foam or sponge, or can be, for example, a helical spring.

Figure 8:
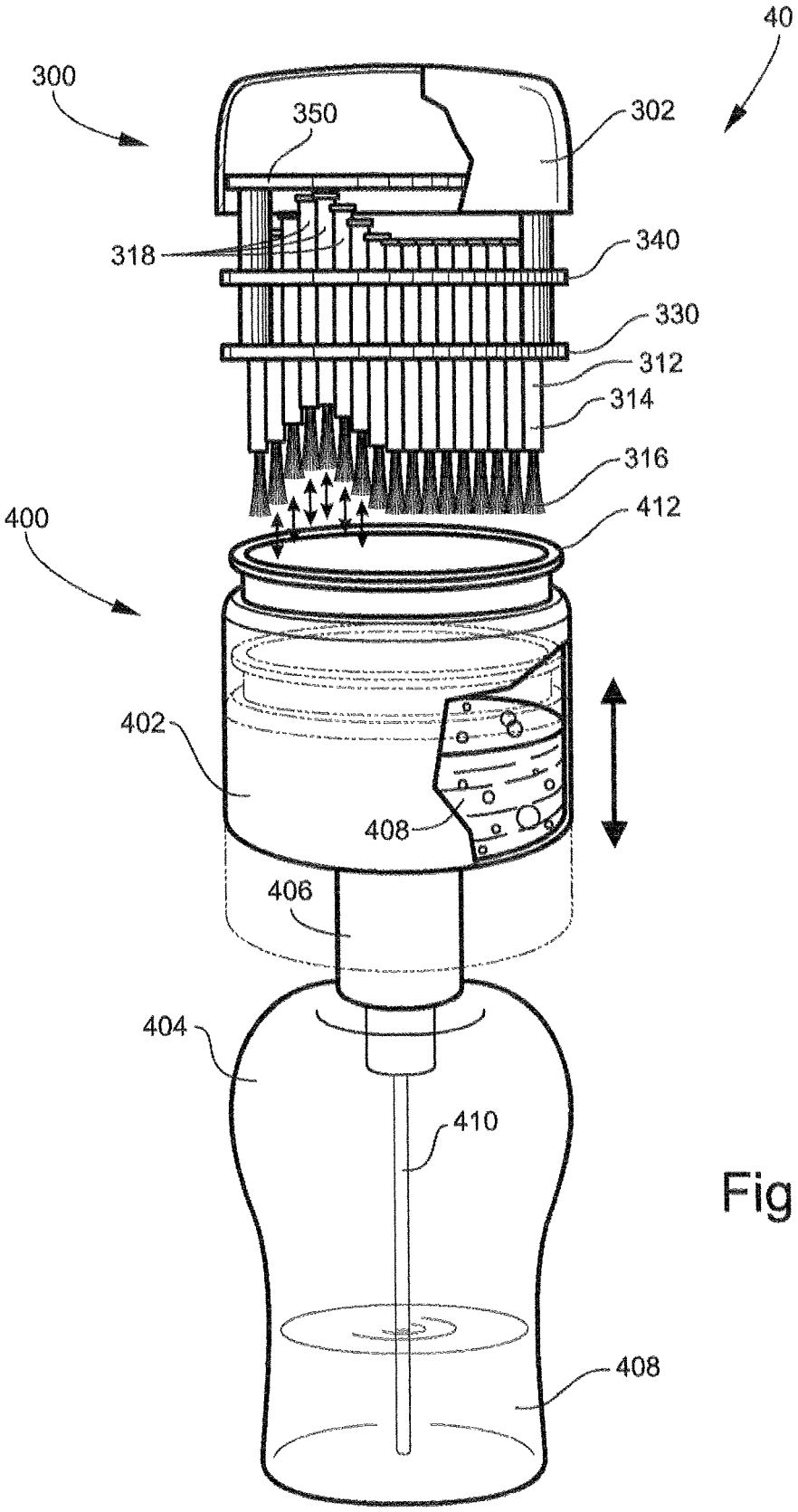
FIG. 8 is a perspective view of a cleaning or applicating kit according to yet another embodiment of the invention, in which both a cleaning or applicating apparatus and a dispensing apparatus are included.

FIG. 8 illustrates a cleaning or applicating kit 40 according to at least one embodiment of the invention. The kit 40 includes a cleaning or applicating first apparatus 300 and a dispensing second apparatus 400. The first apparatus 300 includes a plurality of stems 312, each of which extends and withdraws relative to a base 302 individually by gravity and forces applied to their flexible tips 316 at the free ends 314 of the stems 312 during use. The flexible tips 316 in FIG. 8 are illustrated as brushes consisting of multiple flexible fibers. Other types of tips are nonetheless within the scope of these descriptions.

The dispensing apparatus 400 shown in FIG. 8 includes a plunging cup 402 and a storage vessel 404 mechanically coupled together by a dispensing mechanism 406. The dispensing mechanism 406 includes a spring-loaded pump connected to the storage vessel 404 and cup 402 such that as the cup 402 is pressed down toward the storage vessel, the pump is actuated and dispenses a predetermined metered amount of solution 408 from the storage vessel to the cup 402 through a tube 410. The solution 408 is then available to the flexible tips 316 to bathe the tips and to soak the tips for use where wet cleaning or applicating is desired. The solution can be any desired cleaning solution or solvent including, for example, water, soap solution, alcohol, ammonia, other antibacterial solutions, and other grease-cutting solutions. The solution can also be a liquid to be applied to a surface or to manufactured components, such as an anti-static solution, a lubricating solution such as oil, a paint or other sealing or coating material, a protectant of any kind, a treatment solution, or a powder.

The base 302 of the first apparatus 300 of FIG. 8 serves as a cap that engages and seals with the top edge 412 of the plunging cup 402 of the second apparatus 400. The base 302 can engage the top edge 412 by helical threads or by a snap fit. When the base 302 engages the top edge, the flexible tips 316 are dipped into any solution or material present in the cup 402. The engagement of the base 302 seals the interior of the plunging cup 402 to preserve any solution or material present from evaporation or contamination and to maintain the cleanliness of the flexible tips 316.

Figure 9:
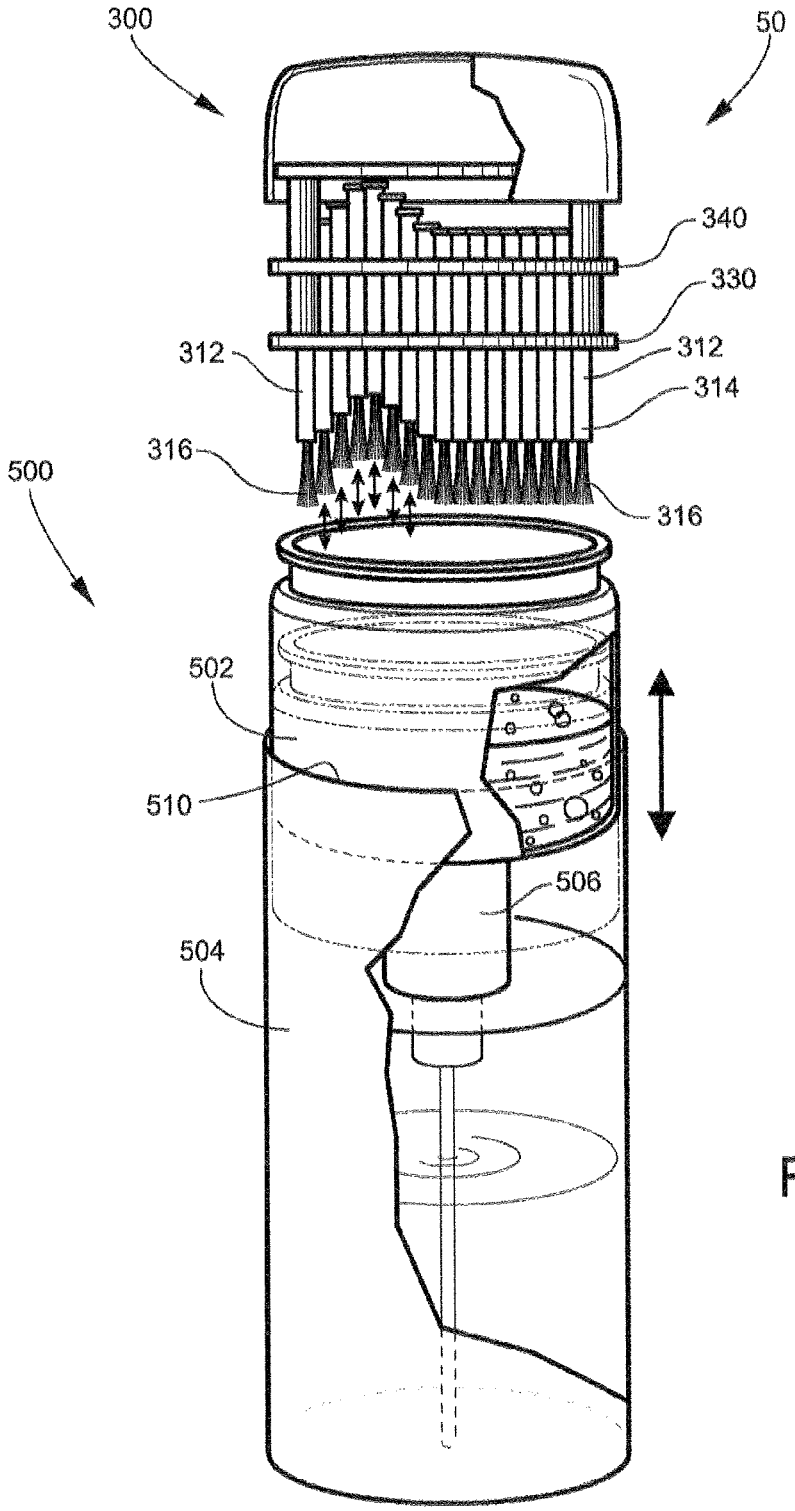
FIG. 9 is a perspective view of another cleaning or applicating kit according to even another embodiment of the invention, in which the cleaning or applicating apparatus of FIG. 8 is included with another dispensing apparatus.

FIG. 9 illustrates another cleaning or applicating kit 50 according to at least one other embodiment of the invention. The cleaning kit 50 includes the above-described cleaning or applicating first apparatus 300 and another material dispensing apparatus 500. The dispensing apparatus 500, as shown in FIG. 8, provides a plunging cup 502 and a storage vessel 504 mechanically coupled together by a dispensing mechanism 506. As the cup 502 is pressed down toward the storage vessel, the dispensing mechanism 506 is actuated to dispense material from the storage vessel to the cup 502. The dispensed material is then available to the flexible tips 316 to bathe and soak the tips for use where wet cleaning or other treatment is desired.

The dispensing mechanism 506 can be a spring-loaded pump that dispenses a predetermined metered amount of material from the storage vessel 504 with each pressing of the cup 502. In another embodiment, the storage vessel is a pressurized canister and the dispensing mechanism includes a valve that permits the release of the pressurized contents of the canister into the cup when the cup is pressed or when the valve is otherwise opened.

The plunging cup 502 telescopes with a snug but sliding fit into the storage vessel 504 and is slidably received within the upper cylindrical wall 510 of the storage vessel. Thus, the plunging cup 502 and storage vessel 504 are durably maintained in parallel relation by the upper cylindrical wall 510 during movement of the plunging cup.

Figure 10:
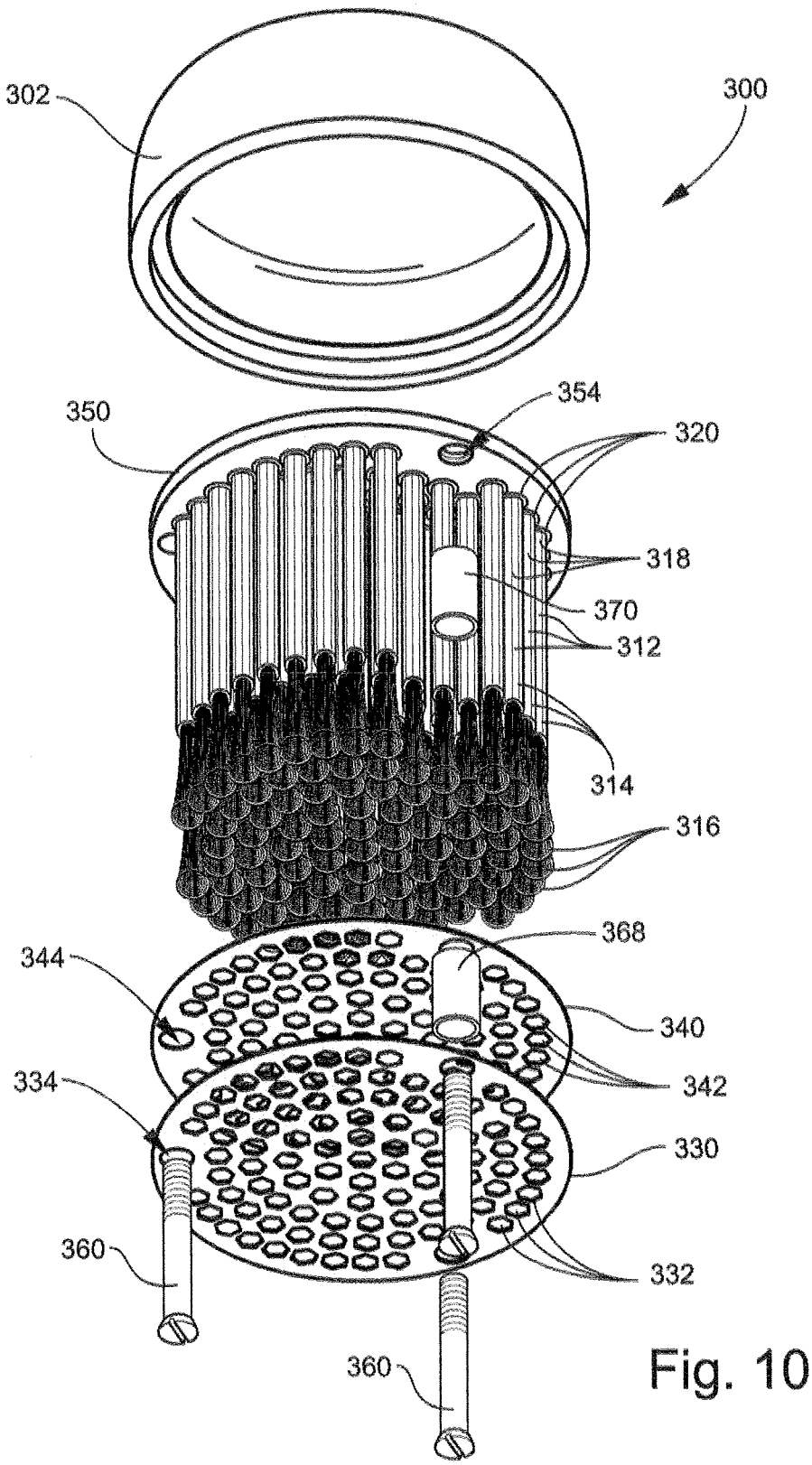
FIG. 10 is an exploded perspective view of the leaning or applicating apparatus of FIGS. 8 and 9.

As shown in FIG. 10, in which the apparatus 300 of FIGS. 8 and 9 is shown disassembled, the base 302 has a face plate 330, and a guiding plate 340 positioned parallel to the face plate 330. The face plate 330 and guiding plate 340 have respective matrices of guide holes 332 and 342. The two matrices are essentially identically patterned so that each individual hole 332 of the face plate 330 aligns with an individual hole 342 of the guiding plate 340 when the apparatus 300 is assembled. The stems 312 are maintained in parallel relation by the aligned guide holes 332 and 342 of the face plate 330 and guide plate 340 throughout the movements of the stems 312. The trapped end 318 of each stem 312 has a head 320 that is enlarged relative to the stem 312. The heads 320 are too large to pass through the guide holes 342 of the guiding plate and thus the stems 312 are retained by the base 302.

A parallel backing plate 350 is positioned on the opposite side of the guiding plate 340 relative to the face plate 330. Each plate 330, 340 and 350 has several respective connector holes 334, 344 and 354 that facilitate the assembly of the apparatus 300 by way of threaded screws 360. First spacers 368 are trapped between the face plate 330 and the guiding plate 340, and maintain the face plate and guiding plate in parallel relation. Second spacers 370 are similarly trapped between the guiding plate 340 and the backing plate 350, and maintain the guiding plate and backing plate in parallel relation.

The guide holes 332 and 342 of the face plate 330 and guide plate 340 are dimensioned and shaped to permit the stems 312 to slide freely between fully extended positions and fully withdrawn positions. It has been found that polygonal guide holes 332 and 342 are advantageous in that they permit movement of the stems 312 even when the face plate 330, guide plate 340, and stems 312 are wet with various solutions. The guide holes 332 and 342 shown in FIG. 10 are polygonal in that each has multiple linear sides. The polygonal guide holes 332 and 342 are believed to reduce surface tensions in solutions that might otherwise form films within the holes, and that by reducing such surface tensions the polygonal guide holes reduce the likelihood that the stems 312 will stick within the guide holes. In the illustrated example, the guide holes 332 and 342 are hexagonal, having exactly six linear sides of equal length. Although the guide holes 132 and 142 in FIG. 2 are shown as round, it should be understood that these descriptions are cumulative, and that features shown in any one Figure can be combined with features shown in any other Figure.

Figure 11:
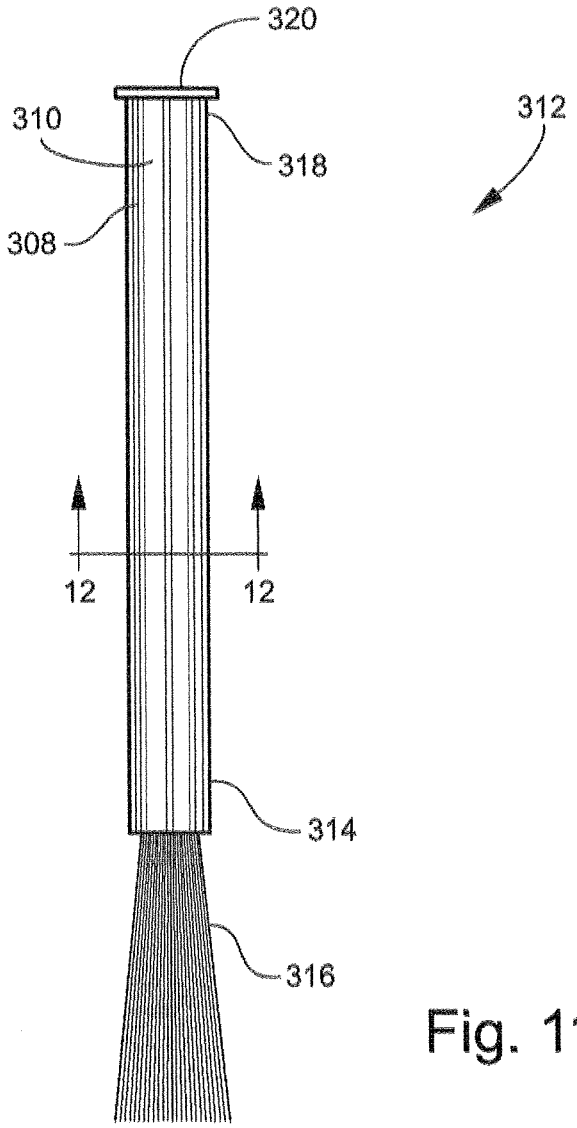
FIG. 11 is an elevation view of one representative stem of the cleaning or applicating apparatus of FIGS. 8-10.
Figure 12:
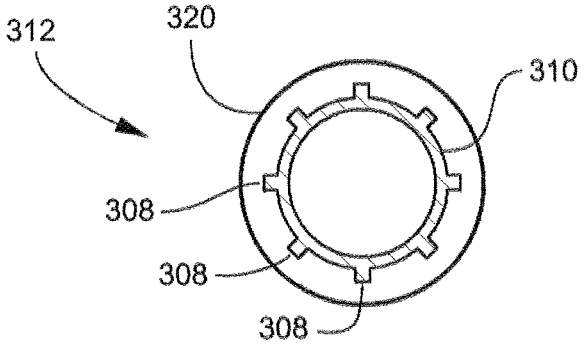
FIG. 12 is a cross-sectional view of the stem of FIG. 11.

A closer view of an exemplary one of the stems 312 of FIGS. 8-10 is provided in FIG. 11. A cross-sectional view of the stem 312 is shown in FIG. 12. The stem 312 has a cylindrical shaft 310 and ridges 308 that extend longitudinally along the shaft. The ridges 308 are advantageous in that they reduce the likelihood of the stems 312 binding within the guide holes 332 and 342 of the face place 330 and guide plate 340. It has been found that the ridges permit movement of the stems 312 even when the face plate 330, guide plate 340, and stems 312 are wet with various solutions. In the illustrated example, the stem 312 has exactly eight ridges that are evenly circumferentially spaced around the shaft 310.

FIG. 10 illustrates a particularly advantageous combination of features in that the stems 312 have longitudinally extending ridges 308 (see FIG. 11) and the guide holes 332 and 342 of the face plate 330 and guide plate 340 are polygonal. Thus, the apparatus 300 has combined features that permit movement of the stems 312 even when the face plate 330, guide plate 340, and stems 312 are wet with various solutions. Each stem 312 has more ridges 308 than each of the guide holes 332 and 342 has linear sides. This is believed to further reduce surface tensions in solutions that might otherwise cause the stems to stick within the holes. In the illustrated example, each stem 312 has exactly eight ridges 308 and each of the guide holes 332 and 342 is hexagonal, having exactly six linear sides of equal length.

While specific embodiments of the present invention have been described, it will be apparent to those skilled in the art that various modifications thereto can be made without departing from the spirit and scope of the invention. For example, a cleaning or applicating apparatus having movable stems according to the invention can be of any size and can have any number of stems. Additionally, these descriptions are cumulative such that features shown in any one Figure or described in any one portion of these descriptions can be combined with features shown or described elsewhere herein. Accordingly, the foregoing description of the preferred embodiment of the invention and the best mode for practicing the invention are provided for the purpose of illustration only and not for the purpose of limitation.

What is claimed is:

1. An apparatus comprising:

a base;

a plurality of rigid stems, each stem having a first end retained by the base and a second end opposite the first end, wherein the stem is movable between a withdrawn position and an extended position with respect to the base, such that the second end projects from the base when the stem is in the extended position; and a plurality of flexible tips attached respectively to the second ends of the stems, wherein each stem has a plurality of longitudinal ridges that extend the full length of the stem.

2. An apparatus according to claim 1, wherein:

the base includes a face plate through which multiple first guide holes are formed;

the base includes a guiding plate positioned parallel to the face plate; the guiding plate has multiple second guide holes aligned respectively with the first guide holes; and the stems slide within, and are maintained parallel to each other by, the aligned first and second guide holes.

3. An apparatus according to claim 2, wherein:

the base further includes a backing plate positioned parallel to the guiding plate opposite the face plate;

the first ends of the stems are retained between the guiding plate and backing plate; and a spacing between the guiding plate and backing plate defines a distance between the withdrawn position and extended position of each stem.

4. An apparatus according to claim 2, wherein the first end of each stem has a respective head dimensioned larger than the second guide holes such that the head is trapped between the guide plate and backing plate.

5. An apparatus according to claim 1, further comprising a biasing element that biases at least one stem toward its extended position.

6. An apparatus according to claim 1, further comprising a biasing element within the base in contact with the first ends of the stems and biasing each stem toward its extended position.

7. An apparatus according to claim 1, wherein each flexible tip comprises a brush, a sponge, a woven material, or a non-woven material.

8. An apparatus according to claim 1, wherein the base has polygonal guide holes through which the stems extend from the base in the extended positions.

9. An apparatus according to claim 8, wherein the polygonal guide holes are hexagonal.

10. An apparatus according to claim 1, wherein:

the base has polygonal guide holes through which the stems extend from the base in the extended positions;

each polygonal guide hole has multiple linear sides;

and each stem has more ridges than each guide hole has linear sides.

11. An apparatus according to claim 10, wherein each stem has exactly eight ridges, and each guide hole has exactly six linear sides.

12. An apparatus according to claim 1, wherein the base has an internal chamber and an inlet port for receiving pressurized gas or fluid into the internal chamber such that the stems are biased toward their extended positions by the pressurized gas or fluid.

13. A kit comprising:

(a) a first apparatus including a base, a plurality of stems, each stem having a first end retained by the base and a second end opposite the first end, wherein the stem is movable between a withdrawn position and an extended position with respect to the base, such that the second end projects from the base when the stem is in the extended position, each stem has a plurality of longitudinal ridges that extend the lull length of the stem, and a plurality of flexible tips attached respectively to the second ends of the stems; and (b) a second apparatus including a storage vessel, a cup dimensioned to receive the flexible tips of the first apparatus, and a dispensing mechanism linking the storage vessel to the cup.

14. A kit according to claim 13, wherein the base comprises a cap that removably engages and seals with a top edge of the cup.

15. A kit according to claim 13, wherein the storage vessel contains a liquid.

16. A kit according to claim 13, wherein the storage vessel comprises a pressurized canister.

17. A kit according to claim 13, wherein the dispensing mechanism comprises a pump connected to the storage vessel and to the cup such that pressing the cup toward the storage vessel actuates the pump.

18. An apparatus according to claim 13, wherein the base has polygonal guide holes through which the stems extend from the base in the extended positions.

* * * * *